United States Patent [19]

Olszewski et al.

[11] Patent Number: 4,594,814

[45] Date of Patent: Jun. 17, 1986

[54] MACHINE FOR AND METHOD OF CHAMFERING OF EDGES OF PLATE-SHAPED WORKPIECES, PARTICULARLY GLASS DISKS

[75] Inventors: Egon Olszewski, Paderborn-Elsen; Klaus-Dieter Schaper, Paderborn-Schloss Neuhaus; Uwe Werner, Enger, all of Fed. Rep. of Germany

[73] Assignee: Benteler-Werke AG, Paderborn, Fed. Rep. of Germany

[21] Appl. No.: 763,422

[22] Filed: Aug. 7, 1985

Related U.S. Application Data

[63] Continuation of Ser. No. 527,305, Aug. 29, 1983, abandoned.

[30] Foreign Application Priority Data

Aug. 27, 1982 [DE] Fed. Rep. of Germany ..... 3231895

[51] Int. Cl.[4] ..... B24B 9/00

[52] U.S. Cl. ..... 51/40; 51/80 A; 51/84 R; 51/283 E

[58] Field of Search ..... 51/34 R, 34 BR, 34 C, 51/40, 74 R, 74 BS, 80 R, 80 BS, 80 A, 82 R, 82 BS, 83 R, 83 BS, 84 R, 84 BS, 92 R, 92 BS, 283 R, 283 E, 284 E; 409/138, 303

[56] References Cited

U.S. PATENT DOCUMENTS

| | | | |
|---|---|---|---|
| 749,551 | 1/1904 | Goehring | 51/283 |
| 1,664,024 | 3/1928 | De Koning | 51/92 R X |
| 2,432,851 | 12/1947 | Anderson | 51/34 C X |
| 2,671,992 | 3/1954 | Reaser et al. | 51/80 |
| 3,082,579 | 3/1963 | Topfer | 51/80 BS |
| 3,187,467 | 6/1965 | Cortesi | 51/283 E X |
| 3,258,878 | 7/1966 | Clark | 51/80 R |
| 3,484,997 | 12/1969 | Allen | 51/80 R |
| 3,680,441 | 8/1972 | Parker | 409/303 X |
| 4,375,738 | 3/1983 | Bando | 51/283 E X |

FOREIGN PATENT DOCUMENTS

| | | |
|---|---|---|
| 2460559 | 12/1977 | Fed. Rep. of Germany . |
| 2723231 | 7/1979 | Fed. Rep. of Germany . |

*Primary Examiner*—Robert P. Olszewski
*Attorney, Agent, or Firm*—Michael J. Striker

[57] ABSTRACT

Chamfering of one or two edges of a glass disk is performed by one or two peripheral grinding wheels which move relative to the glass disk and rotate about axes of rotation which are parallel to the edges to be chamfered.

2 Claims, 3 Drawing Figures

MACHINE FOR AND METHOD OF CHAMFERING OF EDGES OF PLATE-SHAPED WORKPIECES, PARTICULARLY GLASS DISKS

This is a continuation of application Ser. No. 527,305, filed Aug. 29, 1983, now abandoned.

BACKGROUND OF THE INVENTION

The present invention relates to a machine for, and a method of chamfering of edges of plate-shaped workpieces, particularly glass disks. More particularly, it relates to a machine for, and a method of chamfering in accordance with which at least one edge of the workpiece is ground during relative movement between the workpiece and the grinding disk.

It is known not only to round the corner of the glass disks, but also to edge or chamfer the edges of the glass disks for optical and safety reasons, and also in accordance with the requirements for the further treatment of the glass disk. Various glass edge grinding machines have been developed for these purposes.

In known machines of this type, the grinding wheel unit includes two cup-shaped wheels rotatable about axes of rotation which are arranged somewhat normal to the edges to be ground, whereas axes of rotation form with the neighboring outer surface of the glass disk an angle of approximately 135°. Therefore, the axes of rotation are not exactly normal to the edges to be ground, but instead form an acute angle, so that the marginal region of the circular disk-shaped grinding surface of the cup-shaped wheels come in contact with the workpiece with formation of a flat chamfer or a flat edge.

It has been shown that the edge or chamfer produced by these machines and methods has optically highly visible grinding traces.

SUMMARY OF THE INVENTION

Accordingly, it is an object of the present invention to provide a machine for, and a method of chamfering of edges of plate-shaped workpieces, such as glass disks, which can produce edges or chamfers on the workpieces with a higher quality than the known machines and methods.

In keeping with these objects and with others which will become apparent hereinafter, one feature of the present invention resides, briefly stated, in a machine in which a grinding wheel unit has at least one peripheral grinding wheel which rotates about an axis of rotation extending substantially parallel to the edge to be chamfered. The grinding wheel unit of the machine can include two such peripheral grinding wheels which rotate about axes of rotation extending parallel to two edges of the workpiece to be simultaneously chamfered.

Peripheral grinding wheels for working glass disks are known, for example, from DE-AS 2,723,221 or DE-AS 2,460,559. However, the peripheral grinding wheels there serve only for machining the corners of the glass disks, not for chamfering the edges of the glass disks. The present invention is based on the recognition that, in accordance with the inventive machine and method, a concave chamfer is produced, wherein the radius of curvature of the chamfer depends upon the diameter of the peripheral grinding wheel. However, with reasonable dimensioning of the peripheral grinding wheel, this is practically not distinctive or not disadvantageous. It has been shown that the glass disks machined with the inventive machine and method have optically unobjectionable edges, so that no significant grinding traces can be detected.

In accordance with a further feature of the present invention, the axis of rotation of the peripheral grinding wheel forms with the edge to be ground an acute angle which is open in direction of the relative movement of the grinding wheel relative to the workpiece.

Because of this feature, the respective distance between the workpiece and the grinding wheel unit, it is provided that the respective directly ground surfaces extend over the entire width of the peripheral grinding wheel. A symmetrical chamfer relative to the surface broadening the warped edge is provided, when in accordance with the invention the axis of rotation of the peripheral grinding wheel forms an acute angle with the outer surface of the workpiece. The axis of rotation of the grinding wheel forms a substantially equal angle both with the small lateral surface of the workpiece, and also with its outer surface.

Either additionally to the above mentioned angular position of the axis of rotation, or alternatively, it can be provided that the peripheral grinding wheel has the shape of a truncated cone and narrows in the direction of the relative movement of the grinding wheel relative to the workpiece. With appropriate selection of the distance between the grinding wheel unit and the workpiece, the depth of the chamfer, measured from the not available imaginary edge, corresponds to the increase or decrease of the radius of the conical peripheral grinding wheel.

The relative movement between the grinding wheel unit and the workpiece is as a rule carried out by the movement of the workpiece onto the immovable grinding wheel unit. It is however basically possible that the grinding wheel unit is moved onto the immovable workpiece. The grinding wheel unit can basically be composed of only one peripheral grinding wheel, so as to chamfer during one working cycle only one edge. However, it is advantageous when simultaneously two peripheral grinding wheels are provided and rotates about axes of rotation which are offset from the plane of the workpiece relative to one another. The peripheral grinding wheels rotate advantageously in opposite directions in the region of the edge toward the workpiece. Thereby the workpiece is self-centered by the grinding wheels and no high bending stresses are applied, which otherwise could result in breakage of the glass disk.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
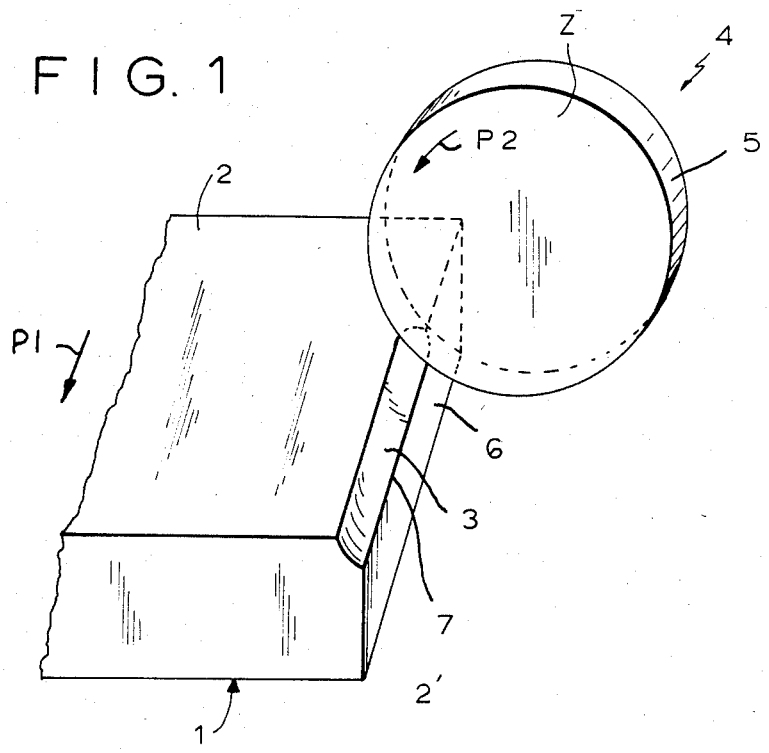
FIG. 1 is a perspective view of a machine with a peripheral grinding wheel for chamfering an upper edge of a glass disk.

In accordance with FIG. 1, a glass plate 1 is displaced for edging or chamfering of its upper edge 2 in direction of the arrow P1 onto an immovable peripheral grinding wheel 4, so as to form a chamfer 3. As shown in the drawing, an axis of rotation Z of the peripheral grinding wheel 4 encloses with the edge 2 of the glass plate 1 to be chamfered an acute angle. This acute angle is open in direction of the relative movement between the grinding disk and the glass plate, oppositely to the arrow P1. The peripheral grinding wheel 4 rotates in the direction of the arrow P2 from an outer surface 1' toward an end surface 1'', and a circumferential grinding surface 5 of the grinding wheel 4 comes into contact with the glass plate 1 in the region of a working surface 6.

Depending upon the diameter of the peripheral grinding wheel 4, the chamfer or the edge 3 has a somewhat concave cross section. This can be seen from the drawing from the somewhat concave edge 7 of the glass disk 1.

Figure 2:
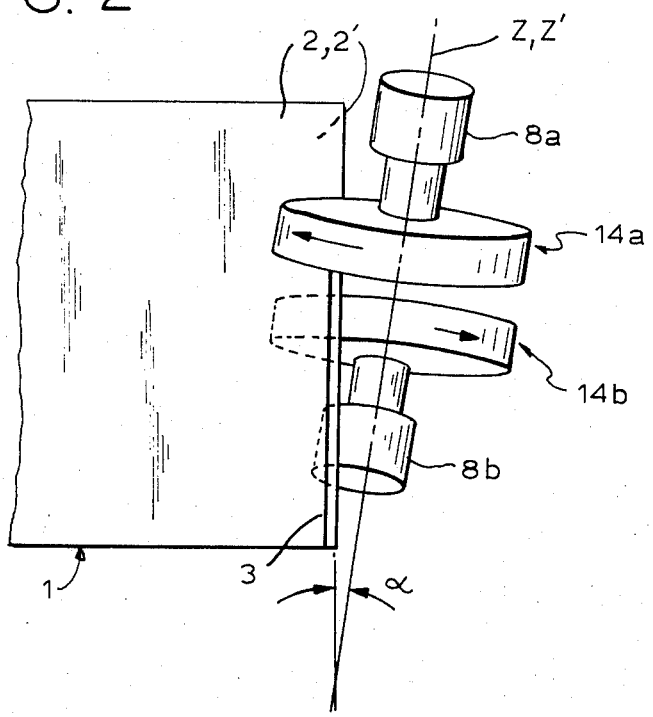
FIG. 2 is a machine in accordance with another embodiment of the invention, in which two peripheral grinding wheels are provided for simultaneous chamfering of two neighboring edges of a glass disk.

The drive means for the grinding wheel 4 is not shown in FIG. 1. When, as shown in the embodiment of FIG. 1, only one peripheral grinding wheel is provided, then during a first working cycle only one edge, namely the edge 2, can be chamfered. When simultaneously with the edge 2 also neighboring lower edge 2' of the glass plate 1 must be chamfered, then the machine has two peripheral grinding wheels. Such an embodiment is shown in FIG. 2. The machine has two drive motors **8*a* and 8*b* which drive two peripheral grinding wheels 14*a* and 14*b* in opposite directions. Axes of rotation Z and Z' which lie over one another in FIG. 2 form with the edges 2 and 2' to be chamfered an acute angle $\alpha$. The peripheral grinding wheel 14*a* works the upper edge 2, whereas the peripheral grinding wheel 14*b* located under the glass plate 1 works the lower edge 2'. As can be seen from the drawing, the peripheral grinding wheels 14*a* and 14*b* form with their axes of rotation not only an acute angle relative to the edges 2 and 2', but also relative to the respective neighboring surface of the glass disk 1**. When the above mentioned angles are equal, the chamfer has a cross section which substantially corresponds to an isoceles triangle.

The rotation of the peripheral grinding wheels **14*a* and 14*b* in opposite directions, as shown in FIG. 2** by the respective arrows, substantially neutralizes the bending forces which act upon the glass plate during the grinding operation, so that no glass breakage danger takes place.

Figure 3:
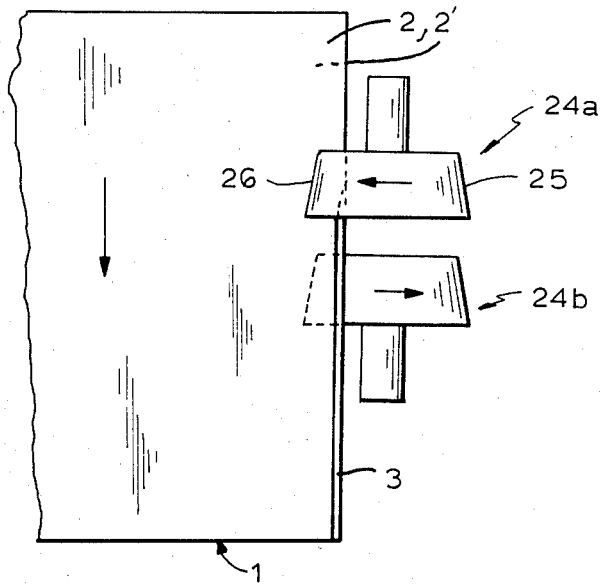
FIG. 3 is a view showing a machine in accordance with a further embodiment of the present invention, in which two truncated-cone-shaped peripheral grinding wheels are provided for chamfering both neighboring edges of a glass disk.

FIG. 3 shows a further embodiment of the invention. In this embodiment, two conical peripheral grinding wheels **24*a* and 24*b* having shape of truncated cones are arranged so that their axes of rotation are offset from the plane of the drawing upwardly and downwardly. The axes of rotation of the wheels 24*a* and 24*b* are parallel to the edges 2 and 2' to be chamfered, respectively. During grinding, a grinding surface 25 of the peripheral grinding wheel 24*a*, which narrows in the direction of the relative movement of the grinding wheels unit relative to the glass plate 1, contacts over its entire width in an axial direction with the glass plate 1 in a region 26 so as to form the chamfer 3. For working of the lower edge 2' of the glass plate 1, the above mentioned is true with respect to the peripheral grinding wheel 24*b*. The peripheral grinding wheels 24*a* and 24*b* rotate in opposite directions each from a respective one of the outer surfaces 1' and 1''' toward the end surface 1''**.

For rotation of the peripheral grinding wheels **24*a* and 24*b* two drive motors similar to those shown in FIG. 2 can be provided. For longitudinal movement of the peripheral grinding wheels along the edges 3**, means can be provided which can move the glass plate toward the peripheral grinding wheels, or move the peripheral grinding wheels toward the glass plate. Such means are known per se in the art and therefore are not shown in the drawing.

It will be understood that each of the elements described above, or two or more together, may also find a useful application in other types of constructions differing from the types described above.

While the invention has been illustrated and described as embodied in a machine for chamfering of edges of plate-shaped workpieces, particularly glass disks, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A machine for simultaneously chamfering two elongated edges which limit an end surface of a plate-shaped workpiece having two outer surfaces at both sides of the end surface and a thickness between the outer surfaces so as to form two chamfers spaced from one another in direction of the thickness, the machine comprising two peripheral grinding wheels each having an axis of rotation, said grinding wheels being movable relative to said workpiece and rotatable about the axes of rotation in opposite directions each from a respective one of the outer surfaces toward the end surface and also movable along a respective one of the edges with an offset relative to one another so as to grind two chamfers, said peripheral grinding wheels being formed as truncated cones oriented with the diameters thereof decreasing in the direction of movement relative to the workpiece and arranged so that their axes of rotation during grinding extend substantially parallel to the edges to be chamfered; and means for moving and rotating said peripheral grinding wheels.

2. A method of simultaneously chamfering two elongated edges which limit an end surface on a plate-shaped workpiece having two outer surfaces at both sides of the end surface and a thickness between the outer surfaces so as to form two chamfers spaced from one another in direction of the thickness, the method comprising the steps of providing two peripheral grinding wheels formed as truncated cones; moving the peripheral grinding wheels relative to the workpiece each along a respective one of the edges with an offset relative to one another, said truncated cone grinding wheels being oriented with the diameters thereof decreasing in the direction of movemnt relative to the workpiece; and rotating the peripheral grinding wheels about their axes, which extend parallel to the edges of the workpiece, in opposite directions each from a respective one of the outer surfaces toward the end surface.

* * * * *